United States Patent [19]

Aschenbrenner

[11] 4,028,871

[45] June 14, 1977

[54] PROCESS AND APPARATUS FOR PRODUCING SPUN YARN

[75] Inventor: Frank A. Aschenbrenner, Matthews, N.C.

[73] Assignee: Cor, Inc., Charlotte, N.C.

[22] Filed: Aug. 23, 1976

[21] Appl. No.: 716,824

[52] U.S. Cl. ..... 57/58.89; 57/5; 57/58.95; 57/156

[51] Int. Cl.[2] ..... D01H 1/12

[58] Field of Search ..... 57/5, 6, 51, 51.6, 58.89–58.95, 57/34 R, 77.3, 156, 12

[56] References Cited

UNITED STATES PATENTS

| | | | |
|---|---|---|---|
| 3,107,478 | 10/1963 | Arshinov et al. | 57/77.3 X |
| 3,537,249 | 11/1970 | Mayer | 57/58.89 |
| 3,670,486 | 6/1972 | Murray | 57/58.89 |
| 3,673,781 | 7/1972 | Breitenbach | 57/58.89 |
| 3,696,600 | 10/1972 | Mayer | 57/58.89 |
| 3,696,603 | 10/1972 | Kotter et al. | 57/58.89 |
| 3,762,148 | 10/1973 | Thrower | 57/34 R X |
| 3,768,243 | 10/1973 | Brown et al. | 57/58.89 |
| 3,845,611 | 11/1974 | Senturk et al. | 57/5 |
| 3,901,012 | 8/1975 | Safar | 57/58.89 |

*Primary Examiner*—Donald Watkins
*Attorney, Agent, or Firm*—Richards, Shefte & Pinckney

[57] ABSTRACT

A process and apparatus for producing spun yarn using an electrostatic field produced by a pair of spaced electrodes, one of which surrounds the other to isolate the electrostatic field therebetween from external physical and electrical disturbances. Staple fibers are fed into the field through an aperture in the surrounding electrode for migration in the electrostatic field to a linear zone of increased field intensity from which the fibers are withdrawn and twisted to form a spun yarn, which may be done without the use of a core yarn or with a core yarn drawn through the linear zone and subjected to a false twisting operation to collect and twist the fibers thereon. Beyond the linear zone is another zone of increased field intensity for electrostatic collection of fly and other waste material. Suction is applied to remove the fly and other waste material from the electrostatic field and also serves to draw the feeding fibers through the aperture into the electrostatic field.

37 Claims, 4 Drawing Figures

2
58
54
60
10
56
2
52
F
20
12
C
22
64
68
24
38
40
26
14
Y
16
18
P
36
44
66
20
50
48
46
28
30
B
2

PROCESS AND APPARATUS FOR PRODUCING SPUN YARN

BACKGROUND OF THE INVENTION

The present invention relates to spinning of yarn, and more particularly to the spinning of yarn using an electrostatic field to collect and align staple fibers for uniform spinning.

The use of an electrostatic field in a spinning operation is known to the art. In a typical prior art operation, staple fibers are injected into an electrostatic field by conventional drafting apparatus that serves as one of the two electrodes creating the electrostatic field, and a twisting device, which serves as the other cooperating electrode, twists and withdraws the fibers from the field in the form of spun yarn. The electrostatic field causes the fibers to receive a net charge as they enter the field and to receive an additional polarization charge which is superposed on the net charge after leaving the feed apparatus. The net charge causes the fibers to be attracted toward the twisting device and the superposed polarization charge causes the fibers to be straightened and simultaneously to migrate toward the line of highest electrostatic field intensity. Devices using this method are now being operated in limited quantities. However, several problems have been observed with these known devices. In particular, cotton fly is generated by the drafting unit and collects at positions on the apparatus near the fiber assembly zone, and the collected fly in random amounts enters the assembly zone and attached to the fibers being spun, thereby causing slubs and yarn breaks. Suction has been tried at the drafting apparatus to remove fly before it enters the electrostatic field, but this has not been wholly effective and results in some usable staple fibers being removed wit the fly. Furthermore, external physical and electrical influences disturb the uniform flow of staple fibers to the assembly zne which is not normally enclosed or protected from these influences. The adverse external influences include aerodynamic gusts and distortion of the electrostatic field by foreign objects placed inadvertently near the fiber assembly zone which disturb uniform fiber flow. Also, machine operators can receive electrical shocks by inadvertently touching the unenclosed high voltage electrodes while performing fly cleaning duties during operation. Past attempts at enclosing the fiber assembly zone have been made using insulating dielectric materials. Unfortunately the dielectric materials became charged by the electrostatic field causing waste fly and fibers to accumulate on the dielectric enclosure, which thereby provided a new source for slubs and end breaks. Furthermore, the dielectric materials, although electrically insulating, do not isolate the electrostatic field from external electrical forces which can distort the field.

An example of a prior art spinning operation using an electrostatic field is disclosed in Senturk and Aschenbrenner U.S. Pat. No. 3,845,611, issued Nov. 5, 1974, For Method and Apparatus for Producing Composite Yarn, wherein a core yarn is fed through the electrostatic field to collect the fibers thereon and is subjected to a false twisting to effect twisting of the fibers on the surface of the core. However, neither this prior art example nor any other known prior operation of the general type provides effective isolation of the fibers in the electrostatic field from external physical and electrical disturbances or any effective means of dealing with the problem of fly and waste assumulation and depositing in the spun yarn.

In contrast, the present invention provides shielding or isolation of the electrostatic field from external physical and electrical disturbances and effectively collects and removes fly and other waste material so that high quality uniform spun yarn can be produced continuously in a commercially satisfactory manner.

SUMMARY OF THE INVENTION

The present invention provides a process and apparatus for producing spun yarn from staple fibers using an electrostatic field and wherein staple fibers are continously fed to an electrostatic field in which the fibers migrate electrostatically to a linear zone of increased field intensity, from which zone the fibers are twisted and withdrawn in the form of a spun yarn. According to one feature, the fibers in the linear zone are physically and electrically shielded from external disturbances so that uniform quality spinning results and the electrical shielding prevents the electrostatic accumulation and depositing of fly and other waste material at locations where it can become included in the spun yarn. In accordance with another feature, the electrostatic field is produced with another zone of increased field intensity spaced from the aforementioned linear zone and disposed for electrostatic collection of fly and other waste material away from the spinning operation. According to another feature, suction is used to remove the fly and other waste material and the same suction serves also to draw fibers from the source of fiber feeding into the influence of the electrostatic field.

In physically and electrostatically shielding the fibers, the electrostatic field is preferably provided by a pair of electrodes with one of the electrodes surrounding the other and serving as an electrically conductive as well as a physical shield. In the preferred embodiment the outer electrode is relatively large, spherical and hollow and the other electrode is relatively small, spherical and located asymetrically within the outer electrode to provide a zone of reduced spacing in which the field intensity is increased for migration of yarns thereto in aligned and linearly oriented position for spinning. By this arrangement the outer electrode serves as a physical shield for the electrostatic field and the fibers therein and, being electrically conductive, it shields the field from any external electrical disturbances. Also, as it is one of the field producing electrodes, there is no tendency for fly and other waste material to be deposited or to accumulate thereon for subsequent dislodgment in clumps that could migrate to the spinning zone and become included in the spun yarn.

The aforementioned feature of providing another zone of increased field intensity serves to collect by electrostatic migration the fly and other waste material that is in the electrostatic field and has passed through or beyond the aforesaid linear zone of increased field intensity from which spinning takes place. Thus, this other increased field intensity zone moves the fly and other waste material froom the field, yet it does not effect or attract the usable stable fibers which, because of their size, are attracted by the field directly to the spinning zone and are retained thereat while the small fly and heavier waste material are not as strongly attracted to the spinning zone but ultimately come under the attraction of the other zone. In the preferred embodiment the linear zone of increased field intensity is disposed between the feeding means and the other zone of increased field intensity, with the feeding means being above the linear zone and the other zone being below the linear zone. In the spherical configuration of the electrodes described above, the other zone is produced by an electrical lead element on the inner electrode, which element extends through the outer spherical electrode and thereby provides a zone of reduced spacing that results in a corresponding increased field intensity.

The aforementioned feature of the use of suction to remove fly and other waste material from the electrostatic field preferably involves the application of suction to the aforesaid other zone of increased field intensity, and is preferably applied below the zone to withdraw waste material that passes through the zones without collection therein as well as fly and other material that is collected in the other zone. In the preferred embodiment the suction also acts across the field on the fiber feeding to draw the fibers from the feeding apparatus into the field. In the form of the invention wherein the outer electrode is a large, hollow sphere enclosing the other electrode the suction has little or no effect on the fibers in the electrostatic field in the large hollow space but does serve to create suction at a small aperture in the outer electrode above the spinning zone to draw fibers from the feeding apparatus through the aperture and into the electrostatic field.

DESCRIPTION OF THE PREFERRED EMBODIMENTS

Figure 1:
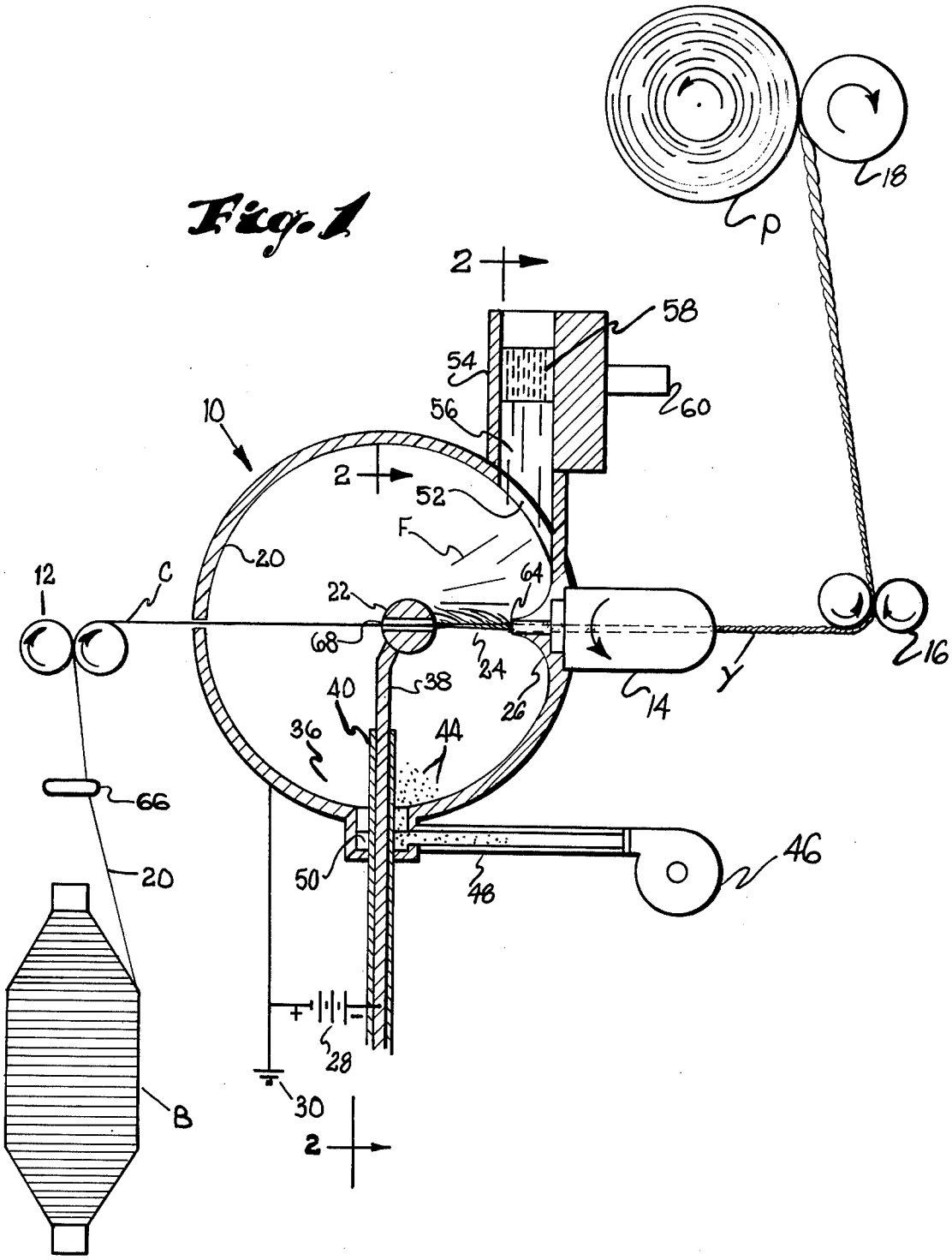
FIG. 1 is a partially schematic and partially in section elevation view of an apparatus according to the preferred embodiment of the present invention.

In the preferred embodiments of the present invention illustrated in the accompanying drawings, the process and apparatus are shown producing a spun core yarn in which staple fibers are twisted tightly and uniformly along the length of a filament core to produce a composite yarn having the interior characteristics of the filament core and the exterior characteristics of the staple fibers. It should be understood that the present invention is applicable as well to spinning of staple fibers into a yarn without the use of a core, in which case the staple fibers are twisted together and withdrawn as a spun yarn by continuous collection of the fibers on the tail of the yarn being formed.

Referring first to FIGS. 1-14 3, the electrostatic spinning apparatus 10 of the present invention is shown receiving a filament core C from a supply bobbin B, with the core C being fed by a pair of feed rolls 12 to the apparatus 10 wherein staple fibers F are electrostatically collected in the zone through which the core C passes for accumulation on the surface of the core C, which is twisted by a false twist mechanism 14 to impart a twist to the fibers F as they are attached to the core C, thereby producing a core spun yarn Y that passes through a pair of take up rolls 16 and is wound on a storage package P that is rotated by a surface contacting roll 18.

Figure 3:
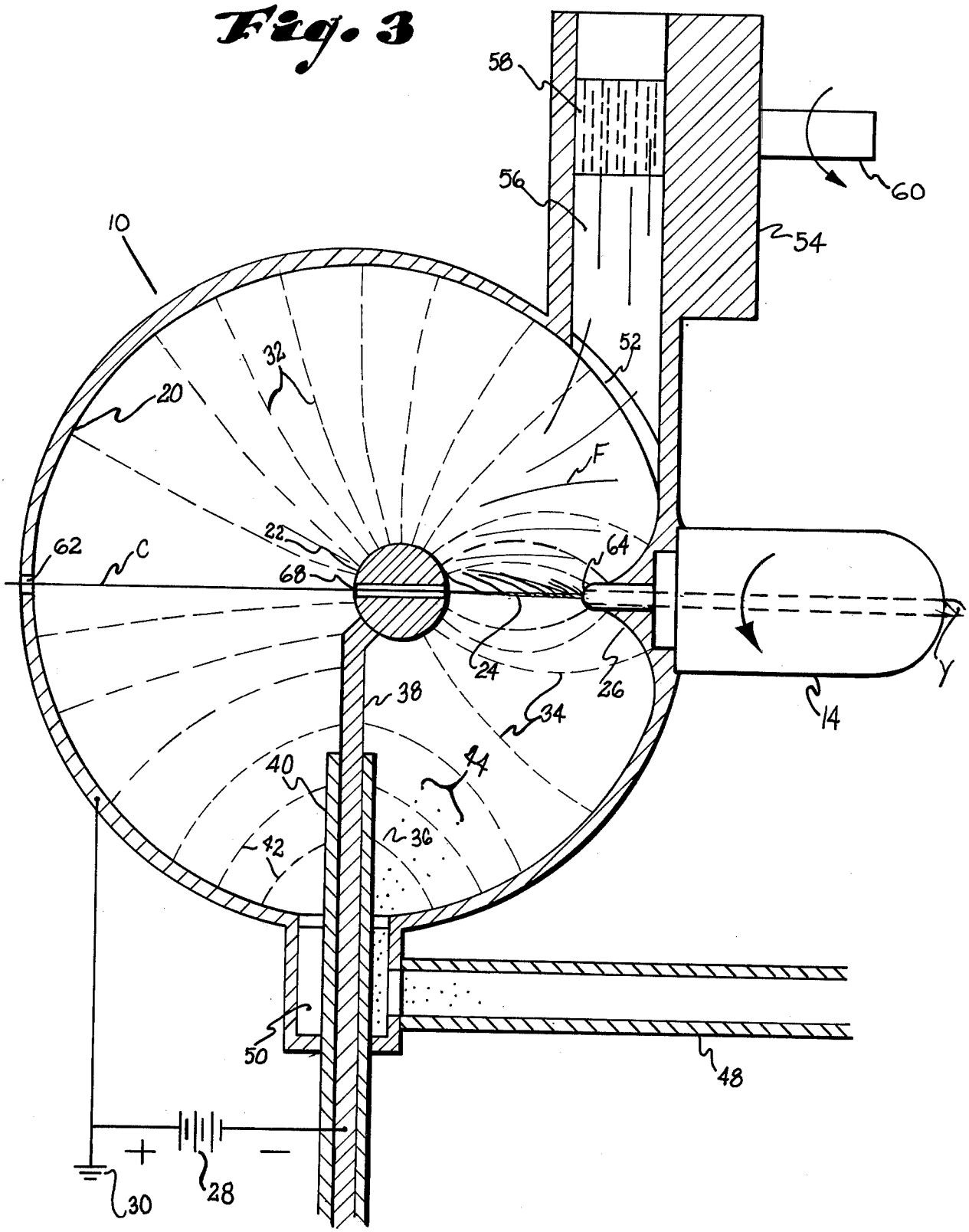
FIG. 3 is an enlargement of the central portion of FIG. 1, including a diagrammatic illustration of the lines of force of electrostatic field intensity.

The electrostatic field used to collect the fibers F for attachment to the core C is produced by means that includes an outer electrode 20 and an inner electrode 22. The outer electrode in the preferred embodiment is generally spherical, hollow and relatively large, and the inner electrode 22 is spherical, relatively small, and located asymetrically within the outer electrode 20. The asymetrical disposition is provided by offsetting the inner electrode horizontally from the center of the outer electrode 20, which results in a decrease in the spacing between the electrodes toward a horizontal linear zone 24 of reduced space, with the spacing decreasing in all directions within the general spherical configuration toward the linear zone 24. The decrease in spacing is accentuated immediately adjacent the linear zone 24 by an inwardly curved tapering of the interior of the inner electrode 22 as indicated at 26 such that the surface projects progressively inward toward the other electrode adjacent the zone to a maximum inward projection at the linear zone 24. With this arrangement, when an electrical potential is imposed between the electrodes by a source of electrical potential 28, which may include grounding of the outer electrode 20 as at 30, an electrostatic field is produced in the spherical interior of the outer electrode 20 between the outer electrode 20 and the inner electrode 22, and with the asymmetrical offset disposition of the inner electrode and the inner taper 26 of the outer electrode 20 and resulting reduction in spacing therebetween resulting in a variation in the intensity of the electrostatic field from a reduced intensity at the greatest spacing diametrically opposite the aforementioned linear zone of reduced spacing through increasing field intensity to the linear zone 24 at which the intensity is substantially increased and being sharply increased immediately adjacent the linear zone 24 by the sharply reduced spacing produced by the aforementioned inner taper 26 of the outer electrode 20. Lines of force indicating the progressive increase in field intensity toward the linear zone 24 in the upper half of the field are illustrated in FIG. 3 by the numeral 32. The electrostatic field in the lower half of the spherical electrostatic field also increases toward the linear zone 24 in the adjacent portion of the field as indicated by the lines of force 34, but toward the lower extent, the field is influenced by another zone 36 of increased field intensity.

The another or secondary zone 36 is produced by the decreased spacing between the hollow outer electrode 20 and a lead element or rod 38 that is a component of the inner electrode 22 and supports the spherical portion thereof within the outer electrode 20. This lead rod 38 extends vertically downward through the outer electrode 20 for connection to the source 28 of electrical potential. A sheath 40 of electrical insulating material encases the lead rod 38 a portion of the distance into the outer electrode 20 and exteriorly thereof to prevent electrical sparking between the lead rod 38 and outer spherical electrode 20. This disposition of the lead rod 38 extending downwardly to and through the outer electrode 20 produces a reduced spacing to a minimum spacing adjacent the bottom of the outer electrode 20 and thereby produces a corresponding increasing field intensity as indicated diagrammatically by the lines of force 42 at the bottom of the outer electrode 20. This secondary zone 36 of increased field intensity collects fly and other waste material indicated schematically by the numeral 44 that is within the hollow spherical interior of the outer electrode 20 and has passed by gravity or suction past the linear or primary zone 24 of increased field intensity or otherwise through the interior of the outer electrode 20.

The fly and other waste material 44 that is collected in the secondary zone 36 of increased field intensity or that falls by gravity to the bottom of the outer electrode 20 is removed by suction applied from a source, such as a suction pump of conventional construction designated schematically by the numeral 46, which is connected by a suction conduit 48 to a sump 50 at the bottom of the outer electrode 20. The suction imposed at the sump 50 and to the secondary zone 36 of increased field intensity is sufficiently concentrated to draw the fly and other waste material 44 collected at the secondary zone 36 and sump 50 through the suction conduit 48, thereby keeping the interior of the outer electrode 20 and the electrostatic field therein clean of such fly and other waste material.

As the hollow interior of the outer electrode 20 is relatively large, the suction is of a relatively small magnitude in any particular location in the electrostatic field above the secondary zone 36. Thus, the suction is of insufficient magnitude at the linear or primary zone 24 to disrupt the migration of fibers F to the primary zone 24 and the alignment and disposition of the fibers F thereat for attachment to the filament core C passing therethrough.

Staple fibers F are fed into the electrostatic zone through a small narrow aperture 52 in the outer spherical electrode 20 above the primary zone 24 of increased field intensity. The feeding of fibers F is accomplished by means mounted in an upward extension 54 of the outer electrode 20 that forms a passageway 56 leading to the aperture 52 and in which passageway 56 a conventional feeding device, such as a lickerin 58, or a conventional drafting unit is mounted and driven in any conventional means through a shaft 60 to separate staple fibers F from a feeding sliver S and dispense the fibers F in separate form into the passageway 56 for discharge through the aperture 52 into the electrostatic field within the outer electrode 20 for migration to the primary zone 24 of increased field intensity. As the aperture 52 is the only significant opening through which air can enter the interior of the outer electrode 20, the aforementioned suction imposed through the suction conduit 48 is concentrated at the aperture 52 and, therefore, in the passageway 56, thereby serving as means for drawing the fibers F downwardly through the passageway 56 and aperture 52 into the electrostatic field. To minimize the effect of the aperture 52 as an absence of electrode surface area, it is formed relatively narrow and parallel with the primary zone 24 of increased field intensity. However, the size and shape of this aperture 52 may be varied as desired to obtain suitable results.

In addition to the aforementioned fiber feeding aperture 52 and sump 50, the outer electrode 20 has a small entry orifice 62 for the filament core C at a position diametrically opposite the linear primary zone 24 and there is also a small yarn exit passageway 64 in the false twist mechanism 14 opening into the electrostatic field through the outer electrode 20 at the outer end of the linear zone 24. However, both the entry orifice 62 and the exit passageway 64 are of relatively insignificant area in comparison with the fiber feed aperture 52 so that the suction imposed for feeding fibers F into the electrostatic field through the aperture 52 is not significantly dissipated by these other openings.

The false twist mechanism 14 is linearly aligned with and adjacent the linear zone 24 and may be of any well known conventional construction driven by an integral motor or a suitable belt drive, and including an interior gripper (not shown) that engages the yarn and permits movement thereof parallel to the axis of the yarn traveling through the mechanism.

Figure 2:
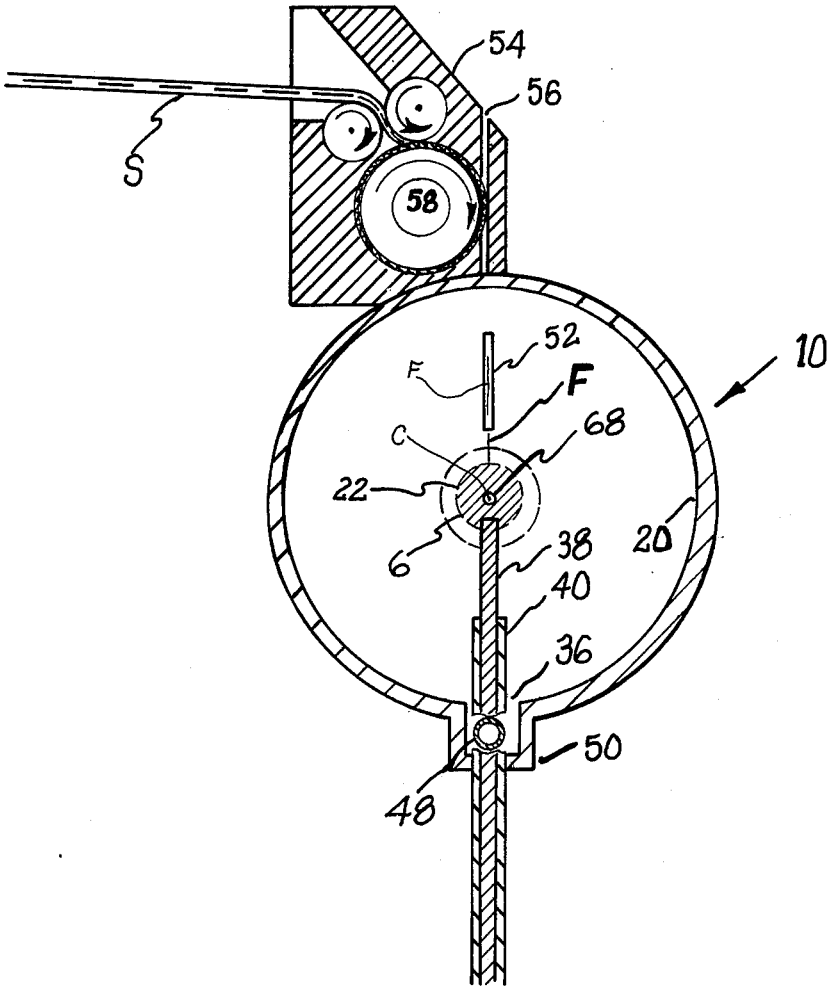
FIG. 2 is a vertical section of the apparatus of FIG. 1 taken along line 2—2 of FIG. 1.

To being operation of the apparatus 10 of the preferred embodiment of FIGS. 1–3, a filament core C is threaded from the bobbin B through a ring guide 66, then through the feed rolls 12 to the outer electrode 20. It is then threaded through the entry orifice 62 into the outer electrode 20 and through a small horizontal central bore 68 in the inner electrode 22. The threading continues through the primary zone 24 in general linear alignment therewith, through the false twist mechanism 14 and finally through the take up rolls 16 to the package P. The source 28 of electrical potential is then energized as is the suction pump 46 and false twist mechanism 14. The feed rolls 12, take up rolls 16 and package contacting roll 18 are then driven. Finally, the lickerin 58 is started and sliver S is fed thereto. The sliver is separated into individual fibers F by the lickerin 58 and is drawn by suction through the passageway 56 and through the aperture 52 into the electrostatic field. As the field intensity is increasing toward the linear zone 24 at the point in which the fibers F first enter the electrostatic field, the fibers electrostatically migrate toward the linear zone 24 with the aforementioned inner taper 26 on the outer electrode 20 causing a rapid increase in field intensity that causes a resulting rapid final migration of the fibers F to the linear zone 24 and a straightening of the fibers F in horizontal disposition linearly oriented in the zone 24. In this position the fibers F contact the surface of the filament core C which is being twisted by the false twist mechanism 14 and is partially twisted by the time it enters the linear zone 24 due to the fact that the twisting is imposed between the feed rolls 12 and the false twist mechanism 14. The contact of the fibers F on the twisting core C causes the fibers F to attach to the core C and be twisted therewith and drawn through the false twist mechanism 14 out of the electrostatic field to form the ultimate spun yarn Y. Beyond the false twist mechanism 14 and prior to passing through the take up rolls 16 the yarn Y is reversely twisted by the action of the false twist mechanism 14 to remove the twist in the core C originally imposed by the false twist mechanism 14 and thereby cause the fibers F to be reversely twisted on the core C. As the initial twisting of the fibers F is only during a portion of the twisting of the core prior to passing through the entire reverse twisting beyond the false twist mechanism 14, the fibers F will reverse twist a greater amount than they were initially twisted, resulting in a residual twisted disposition on the surface of the yarn Y, thereby providing the surface characteristics of the fiber material on the resulting composite yarn Y.

During the operation of the apparatus 10 as described above, short fibers or fly and other waste material are carried by the advancing sliver to the lickerin 58 and feed with the fibers F into the electrostatic field. However, as the pieces of fly are relatively short, they are not affected by the electrostatic field to the same extent that the fibers F are affected and they do not tend to migrate to the linear zone 24 in the same degree but will pass through the electrostatic field generally uncontrolled, being under a slight drawing by the suction toward the bottom of the outer electrode 20, with the increasing field intensity toward the secondary zone 36 causing the fly ultimately to migrate to the bottom of the outer electrode 20 and be drawn off by the increased effect of the suction thereat through the suction conduit 48. Other waste material that enters the electrostatic field is affected the same way as the fly if it is lightweight, and if it is heavy it falls by gravity through the electrostatic field into the sump 50 from which it is also withdrawn by suction through the conduit 48.

It should be noted that the field intensity between the primary zone 24 and the secondary zone 36 is reduced in comparison with the intensity in the zones themselves. Thus, any usable fibers F that happen to initially pass the primary zone 24 will likely be under the influence of the increasing intensity back toward the primary zone 24 rather than continuing on toward the increasing field intensity influence of the secondary zone 36.

The rate of feed of the fibers F and element core C, the rate of twisting by the false twist mechanism 14, the amount of suction and the intensity of the electrostatic field may all be varied to suit particular conditions and obtain particular results. Thus, a range of suction of between 10 and 60 feet per minute at the aperture 52 would be representative, and a range of potential voltage of 10,000 to 60,000 volts between the electrodes 20 and 22 would be representative. Preferably, the outer electrode 20 is at ground potential to prevent harm to someone inadvertently touching the exterior of the electrode and the inner electrode 22 is either negative or positive at the selected voltage. However, both electrodes could be positive or both negative with a different voltage potential applied to obtain the desired electrostatic field condition.

To serve as a shield or isolator for the fibers F in the electrostatic field and thereby prevent external physical and electrical disturbances, the outer electrode 20 preferably completely encloses the electrostatic field, thereby preventing any foreign material from inadvertently physically entering the electrostatic field and being a conductor it repels accumulation thereon of fly or other waste material that could build into clumps that would ultimately break loose and possibly become entangled in the fibers F at the primary zone 24, causing slubs and breakage in the yarn Y. Although it is preferred that the outer electrode 20 completely enclose the electrostatic field, it may be possible to operate satisfactorily with less than a full enclosure, provided adequate shielding is imposed to protect the primary zone 24 and the fibers F migrating thereto. In this regard, satisfactory results may also be possible with the outer sphere only being partially electrically conductive, provided that the surface area where the fly and other waste material could otherwise accumulate and ultimately pass into the primary zone 24 is electrically conductive to prevent formulation of slubs or breakage of yarn.

The electrodes 20 and 22 may be made of suitable electrically conductive material, such as steel, cooper or aluminum or may be coated or covered by a layer of conductive material, such as copper or aluminum. Typically, the insulating material of the sheath 40 is acrylic or Teflon or a similar electrically insulating material.

Although in the embodiment illustrated a false twist is imposed by the mechanism 14, which is the preferable arrangement, satisfactory results could be obtained by a twisting mechanism of conventional construction that does not include a reverse twisting, but is simply a one directional twisting operation, or one of the electrodes could be disposed in some manner for rotation to produce the twist. Similarly, the shapes of the electrodes may be varied as desired. The spherical configuration shown in FIGS. 1–3 is simply representative. Various other shapes could be utilized that produce the spacing results for formation of the primary and secondary zones 24 and 36 of increased field intensity and a volume sufficient to reduce the suction effect on the fibers in the field so that the fibers will properly migrate to the primary zone 24.

Figure 4:
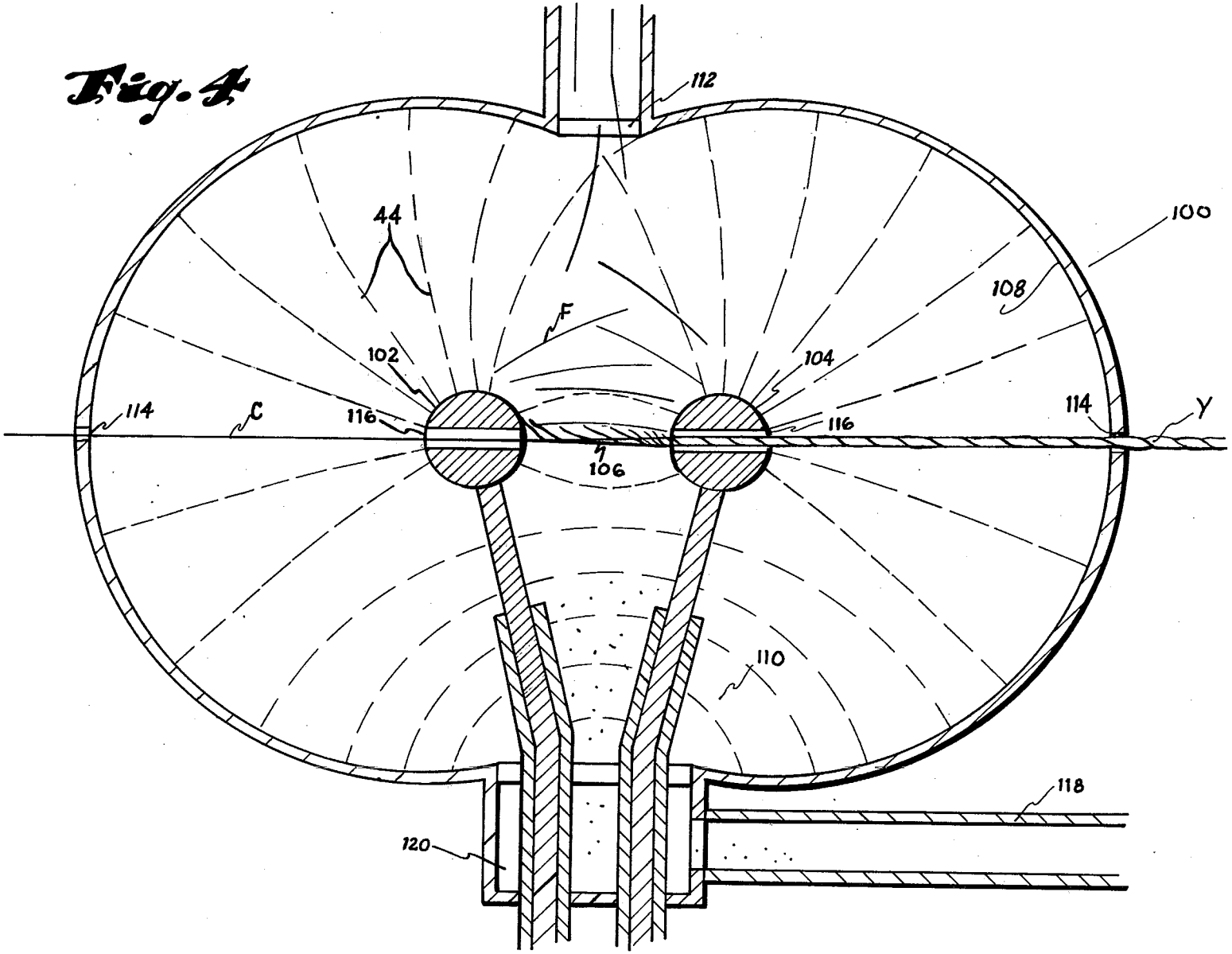
FIG. 4 is a view similar to FIG. 3, but illustrating a variation of the preferred embodiment.

An example of a variation of the configuration of the electrodes is shown in FIG. 4 wherein the apparatus 100 has two inner electrodes 102 and 104 similar to the single inner electrode 22 of the embodiment of FIGS. 1–3. In this case, the two inner electrodes are spaced horizontally to provide the linear zone 106 of increased field intensity therebetween and a voltage potential is enclosed between the two inner electrodes 102 and 104 for this purpose. Physical and electrical shielding of the inner electrodes is accomplished by an outer electrically conductive shell 108 in the form of two partial spheres joined together to form a common interior. This outer shell 108 is electrically grounded or charged to provide an electrical shield as well as a physical shield, and a secondary electrostatic field is developed between the inner electrodes 102 and 104 and the outer shell 108, and a secondary zone 110 of increased field intensity is produced at the bottom of the outer shell 108 in the same manner for the same purposes as in the embodiment of FIGS. 1–3. In the form of FIG. 4 staple fibers F are introduced from a feeding means through an aperture 112 directly above the linear zone 106 to which the fibers F migrate and are attached to the core C that is being twisted as it passes through orifices 114 in horizontally opposite extremities of the outer shell 108 and through horizontal central bores 116 in the inner electrodes 102 and 104. Also in this embodiment, suction is imposed through a suction duct 118 to draw fly and trash from the secondary zone 110 and a sump 120 in the bottom of the outer shell 108.

The staple fibers used in any of the embodiments of the present invention for spinning either a core covered yarn or a yarn without a core may be either natural or synthetically produced fibers of non-metallic content. Similarly, the filament core for the core type yarn may consist of any non-metallic synthetically produced filament yarn or a previously produced spun yarn made of non-metallic staple fibers. Further, the invention is not intended to be limited to the use of only one filament core or no filament core as it is applicable as well to the spinning of staple fibers onto more than one filament core passing through the primary zone. In addition, the staple fibers and the filament core may be stretch or non-stretch material.

Although the present invention has been described in relation to the preferred embodiments, it is to be understood that modifications and variations may be resorted to without departing from the substance of scope of the present invention as those skilled in the art will readily understand. Such modifications and variations are within the scope of the present invention, which is intended to be limited only by the appended claims and equivalents thereof.

I claim:

1. A process for producing spun yarn from staple fibers using an electrostatic field comprising continuously feeding fibers to an electrostatic field, electrostatically migrating said fibers in said field to a linear zone of increased field intensity in which said fibers are generally linearly oriented while physically and electrically shielding said fibers in said electrostatic field from external physical and electrical disturbances, and twisting and withdrawing said fibers from said zone in the form of a spun yarn.

2. A process for producing spun yarn from staple fibers according to claim 1 and characterized further by collecting at a spacing from said zone fly and other waste material that enters said electrostatic field but which is not withdrawn with said twisted fibers.

3. A process for producing spun yarn from staple fibers according to claim 2 and characterized further in that said collecting includes applying suction.

4. A process for producing spun yarn from staple fibers according to claim 3 and characterized further by applying said suction to effect said feeding of fibers.

5. A process for producing spun yarn according to claim 1 and characterized further in that said twisting and withdrawing of said fibers includes continuously feeding a core yarn through said linear zone in generally linear alignment therewith to collect said staple fibers thereon while twisting said core yarn as it feeds through said zone to twist said staple fibers thereon.

6. A process for producing core spun yarn according to claim 5 and characterized further in that said twisting of said core yarn is begun before said yarn is in said linear zone so that said yarn is pretwisted prior to collection of said staple fibers thereon, and by untwisting of said yarn following collection of said fibers thereon to reverse the twist of said fibers.

7. A process for producing spun yarn from staple fibers using an electrostatic field comprising continuously feeding fibers to an electrostatic field, electrostatically migrating said fibers in said field to a linear zone of increased field intensity in which said fibers are generally linearly oriented, twisting and withdrawing said fibers from said zone in the form of a spun yarn, and collecting at a spacing from said zone fly and other waste material that enters said electrostatic field but which is not withdrawn with said twisted fibers.

8. A process for producing spun yarn from staple fibers according to claim 7 and characterized further in that said feeding of fibers is performed above said linear zone of increased field intensity and said collecting of fly and other waste material is performed below said zone.

9. A process for producing spun yarn from staple fibers according to claim 7 and characterized further in that said collecting includes applying suction.

10. A process for producing spun yarn from staple fibers according to claim 9 and characterized further by applying said suction to effect said feeding of fibers.

11. A process for producing spun yarn from staple fibers according to claim 7 and characterized further in that said collecting fly and other waste material includes using another zone of increased field intensity acting on said fly and other waste material at a spacing from said linear zone.

12. A process for producing spun yarn from staple fibers according to claim 11 and characterized further in that said feeding of fibers is performed above said linear zone and said another zone is spaced below said linear zone.

13. A process for producing spun yarn from staple fibers according to claim 12 and characterized further in that said collecting of fly and other waste material includes applying suction through said another zone.

14. A process for producing spun yarn according to claim 7 and characterized further in that said twisting and withdrawing of said fibers includes continuously feeding a core yarn through said linear zone in generally linear alignment therewith to collect said staple fibers thereon while twisting said core yarn as it feeds through said zone to twist said staple fibers thereon.

15. A process for producing spun yarn according to claim 14 and characterized further in that said twisting of said core yarn is begun before said yarn is in said linear zone so that said yarn is pretwisted prior to collection of staple yarn thereon, and by untwisting of said yarn following collection of said fibers thereon to reverse the twist of said fibers.

16. Apparatus for producing spun yarn from staple fibers comprising means for producing an electrostatic field having a linear zone of increased field intensity, means for continuously feeding fibers to said electrostatic field for electrostatic migration of fibers by said field to said zone, said electrostatic field producing means including means for physically and electrically shielding said fibers in said linear zone from external disturbances, and means for twisting and withdrawing said fibers from said zone in the form of a spun yarn.

17. Apparatus for producing spun yarn according to claim 16 and characterized further in that said shielding means comprises electrically conductive means.

18. Apparatus for producing spun yarn according to claim 16 and characterized further in that said electrostatic field producing means comprises a pair of spaced electrodes having an electrical voltage potential therebetween for producing an electrostatic field and being shaped to provide a linear zone of reduced spacing therebetween to provide for development thereat of increased field intensity, and said shielding means comprises one of said electrodes.

19. Apparatus for producing spun yarn according to claim 18 and characterized further in that said shielding means electrode substantially encloses the space in which said fibers are under the influence of said electrostatic field.

20. Apparatus for producing spun yarn according to claim 19 and characterized in that said one electrode is relatively large and hollow, and the other of said electrodes is relatively small and disposed in spaced relation within said hollow electrode.

21. Apparatus for producing spun yarn according to claim 20 and characterized further in that said other electrode is asymetrically disposed in said one electrode to provide said zone of reduced spacing.

22. Apparatus for producing spun yarn according to claim 21 and characterized further in that said electrodes are generally spherical.

23. Apparatus for producing spun yarn according to claim 22 and characterized further in that said one electrode projects progressively inwardly toward said other electrode adjacent said zone of reduced spacing to intensify further the electrostatic field thereat.

24. Apparatus for producing spun yarn according to claim 20 and characterized further in that said electrodes are disposed to provide increasing electrostatic field intensity from said feeding means to said linear zone and are further disposed to provide another zone of reduced spacing spaced from said linear zone to provide increased field intensity thereat for electrostatic collection of fly and other waste material thereat.

25. Apparatus for producing spun yarn according to claim 24 and characterized further in that said electrodes are disposed to locate said linear zone between said feeding means and said another zone.

26. Apparatus for producing spun yarn according to claim 25 and characterized further in that said linear zone is substantially horizontally disposed, said feeding means is above said linear zone, and said another zone is below said linear zone.

27. Apparatus for producing spun yarn according to claim 26 and characterized further by means for applying suction to said another zone to remove collected fly and other waste material therefrom,

28. Apparatus for producing spun yarn according to claim 24 and characterized further in that said other electrode includes an electrical lead element extending into said one electrode and providing therewith said another zone of reduced spacing.

29. Apparatus for producing spun yarn according to claim 24 and characterized further by means of applying suction to said another zone to remove collected fly and other waste material therefrom.

30. Apparatus for producing spun yarn according to claim 29 and characterized further in that said one electrode is provided with a relatively small aperture for feeding of fibers therethrough from said feeding means, and said applied suction draws fibers from said feeding means through said aperture into said electrostatic field.

31. Apparatus for producing spun yarn according to claim 16 and characterized further in that said means for withdrawing and twisting fibers comprises a false twist mechanism linearly aligned with and adjacent said linear zone for imposing a false twist on a core yarn being drawn through said linear zone to collect said staple fibers thereon in a twisted condition.

32. Apparatus for producing spun yarn from staple fibers comprising means for producing an electrostatic field having field intensity increasing to a zone of increased field intensity, means for continuously feeding fibers to said field for electrostatic migration of the fibers by said increasing field intensity to said linear zone, means for twisting and withdrawing said fibers from said zone in the form of a spun yarn, and said electrostatic field producing means providing another zone of increased field intensity spaced from said linear zone for electrostatic collection of fly and other waste material at said another zone.

33. Apparatus for producing spun yarn according to claim 32 and characterized further in that said linear zone is located between said feeding means and said another zone.

34. Apparatus for producing spun yarn according to claim 33 and characterized further in that said linear zone is substantially horizontally disposed, said feeding means is above said linear zone, and said another zone is below said linear zone.

35. Apparatus for producing spun yarn according to claim 32 and characterized further by means for applying suction to said another zone to remove collected fly and other waste material therefrom.

36. Apparatus for producing spun yarn according to claim 35 and characterized further in that said means for producing an electrostatic field includes substantial enclosure of said electrostatic field and said suction applying means applies said suction in said enclosure to draw fibers from said feeding means into said electrostatic field.

37. Apparatus for producing spun yarn according to claim 36 and characterized further in that said enclosure is provided with a relatively small aperture for feeding of fibers therethrough from said feeding means, and said applied suction draws fibers from said feeding means through said aperture into said electrostatic field.

* * * * *

UNITED STATES PATENT OFFICE

CERTIFICATE OF CORRECTION

Patent No. 4,028,871 Dated June 14, 1977

Inventor(s) Frank A. Aschenbrenner

It is certified that error appears in the above-identified patent and that said Letters Patent are hereby corrected as shown below:

Column 1, line 32, "attached" should read -- attaches --; Column 1, line 37, "wit" should read -- with --; Column 1, line 39, "zne" should read -- zone --; Column 2, line 1, "assumulation" should read -- accumulation --;

Column 2, line 60, "froom" should read -- from --; Column 3, line 56, "1-143" should read -- 1-3 -- ; Column 6, line 10, "being" should read -- begin --; Column 8, line 5, before "is" insert -- it --; Column 11, line 20, "," should read -- . --

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*